US009631353B1

(12) United States Patent
Walker

(10) Patent No.: US 9,631,353 B1
(45) Date of Patent: Apr. 25, 2017

(54) CANTILEVERED BRACE ASSEMBLY FOR WALL-MOUNTED TOILET

(71) Applicant: Modular Services Company, Oklahoma City, OK (US)

(72) Inventor: James A. Walker, Oklahoma City, OK (US)

(73) Assignee: Modular Services Company, Oklahoma City, OH (US)

( * ) Notice: Subject to any disclaimer, the term of this patent is extended or adjusted under 35 U.S.C. 154(b) by 0 days.

(21) Appl. No.: 14/677,430

(22) Filed: Apr. 2, 2015

Related U.S. Application Data

(63) Continuation of application No. 12/354,150, filed on Jan. 15, 2009, now Pat. No. 9,021,620.

(51) Int. Cl.

| | |
|---|---|
| ***E03D 11/00*** | (2006.01) |
| ***E03D 11/14*** | (2006.01) |
| ***E03D 1/00*** | (2006.01) |
| ***E03D 11/16*** | (2006.01) |

(52) U.S. Cl.
CPC ..... *E03D 11/143* (2013.01); *E03D 1/006* (2013.01); *E03D 11/16* (2013.01)

(58) Field of Classification Search
CPC ..... E03D 11/143
USPC ..... 4/252, 252.1, 252.2, 252.3, 329, 420, 4/430, 431, 432, 453
See application file for complete search history.

(56) References Cited

U.S. PATENT DOCUMENTS

| | | | | |
|---|---|---|---|---|
| 3,221,454 | A * | 12/1965 | Giulio Togni | E03C 1/01 137/376 |
| 5,067,185 | A * | 11/1991 | Kohler | A47K 13/16 4/245.1 |
| 5,724,773 | A * | 3/1998 | Hall | E03D 11/143 52/220.1 |
| 5,909,968 | A * | 6/1999 | Olin et al. | E03D 5/00 4/252.2 |
| 6,986,171 | B1 * | 1/2006 | Perrin | E03D 11/12 4/300.2 |

* cited by examiner

*Primary Examiner* — Arthur O Hall
*Assistant Examiner* — Joel Zhou
(74) *Attorney, Agent, or Firm* — Mary M. Lee

(57) ABSTRACT

A brace for a wall-mounted toilet, particularly useful for wall-mounted porcelain toilets in hospitals and other health care facilities. The brace includes a weight receiving structure supported by cantilevered struts that attach the brace to the wall, preferably using the same bolts that attach the toilet to the wall. The weight receiving structure may be a seat portion that overlies the rim of the toilet bowl, so that the weight of the user is transmitted from the toilet seat to the seat structure and then to the walls through the struts. Alternately, the weight receiving structure may include an under-bowl support that extends underneath the toilet bowl so that the user's weight is transmitted from the bowl to the wall through the struts. Thus, the cantilevered brace increases the weight-bearing capacity of the wall-mounted toilet. A plastic shroud may be included for enclosing the brace and toilet bowl.

26 Claims, 11 Drawing Sheets

CANTILEVERED BRACE ASSEMBLY FOR WALL-MOUNTED TOILET

This application is a continuation of co-pending application Ser. No. 12/354,150, entitled "Cantilevered Brace Assembly For Wall-Mounted Toilet," filed Jan. 15, 2009, the contents of which are incorporated herein by reference.

FIELD OF THE INVENTION

The present invention relates to wall-mounted toilets generally and, in particular but without limitation, to wall-mounted porcelain toilets.

BACKGROUND OF THE INVENTION

Wall-mounted porcelain toilets are commonly used in hospitals and other health care settings. Porcelain is preferred because it is relatively inexpensive and unreactive to most cleaning compounds. The off-the-floor mounting allows easy cleaning of the floor around and under the toilet. However, these toilets are not well-suited to very heavy and obese patients; the wall-mount configuration is weaker and porcelain is more likely to break under excess weight than stainless steel.

Thus, there is a need for a support structure for wall-mounted porcelain toilets that will allow such toilets to support heavier patients. There is also a need for a support frame that does not interfere with cleaning the floor under the toilet. Still further, there is a need for a support frame that can be retro-fitted easily on to existing toilets.

DETAILED DESCRIPTION OF THE PREFERRED EMBODIMENTS

Figure 1:
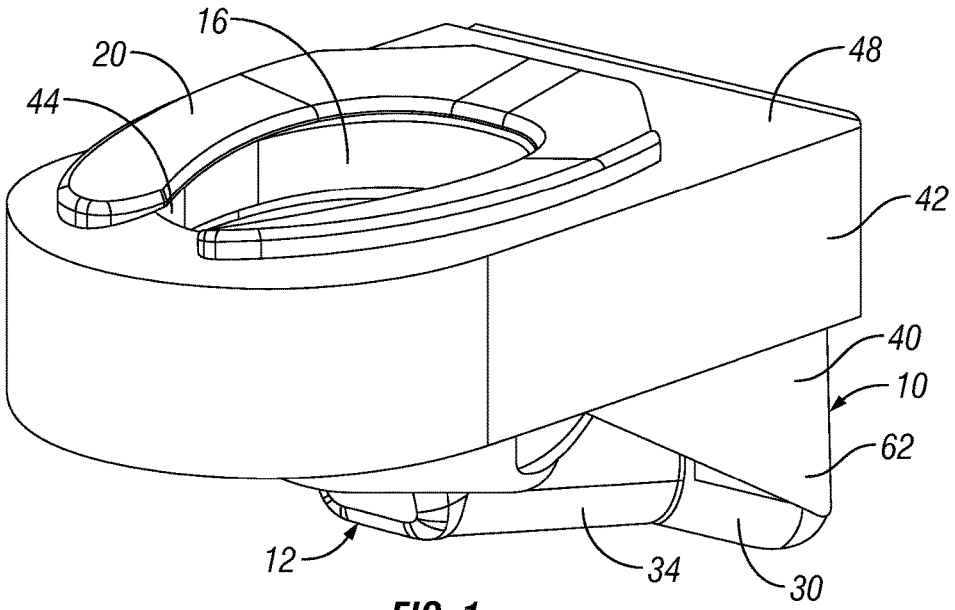
FIG. 1 is a top perspective view of a toilet equipped with a cantilevered support in accordance with the present invention. In this embodiment, the support assembly includes a shroud that underlies the toilet seat.

Turning now to the drawings in general and to FIG. 1 in particular, there is shown therein a wall-mounted toilet equipped with a cantilevered brace assembly constructed in accordance with a preferred embodiment of the present invention forming a toilet assembly designated generally by the reference numeral 10. The toilet 12 shown in the drawings is a conventional wall-mounted porcelain toilet that is commonly used in hospitals and other medical facilities.

Figure 3:
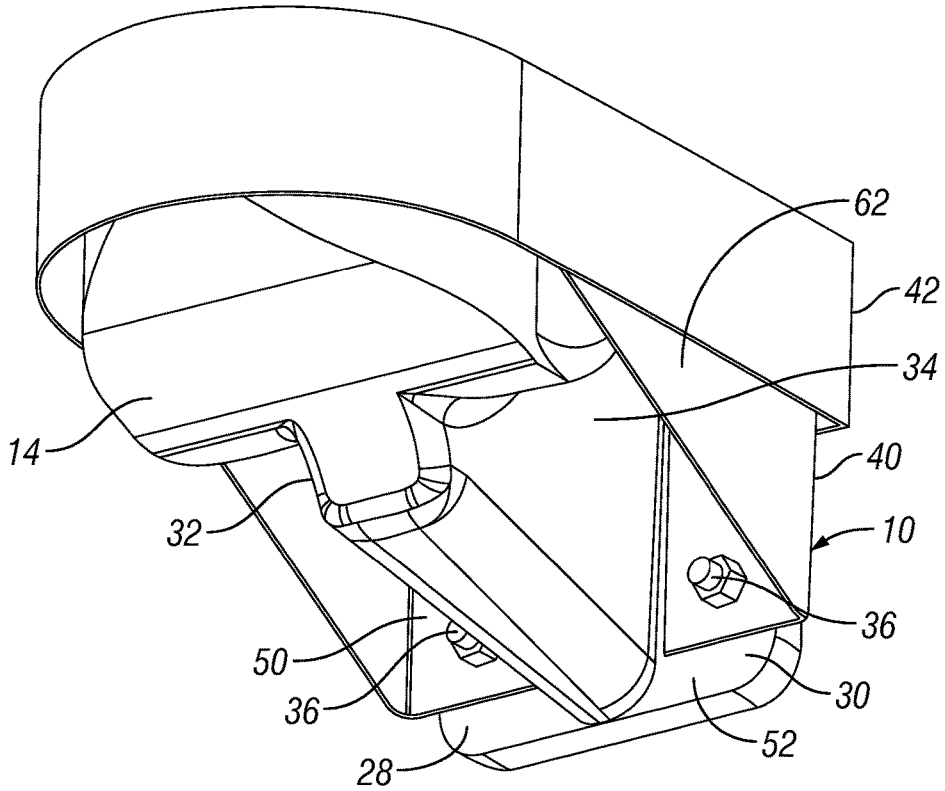
FIG. 3 is a bottom perspective view of the support assembly of FIG. 1.
Figure 4:
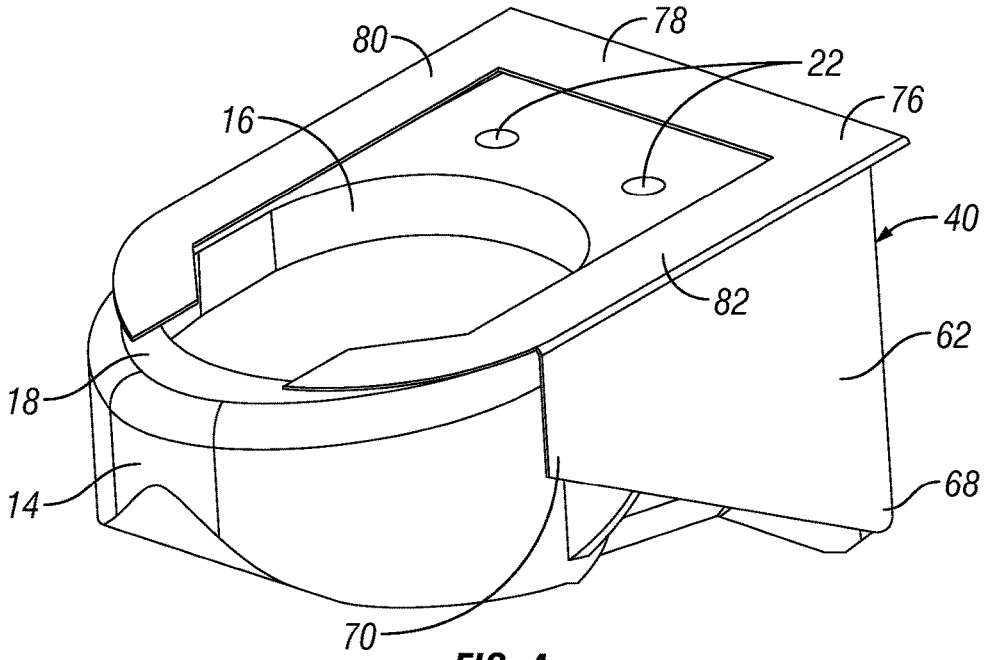
FIG. 4 is a top perspective view of the support assembly of FIG. 1 with the shroud removed showing how the top of the frame overlies the edge of the toilet bowl under the toilet seat.
Figure 6:
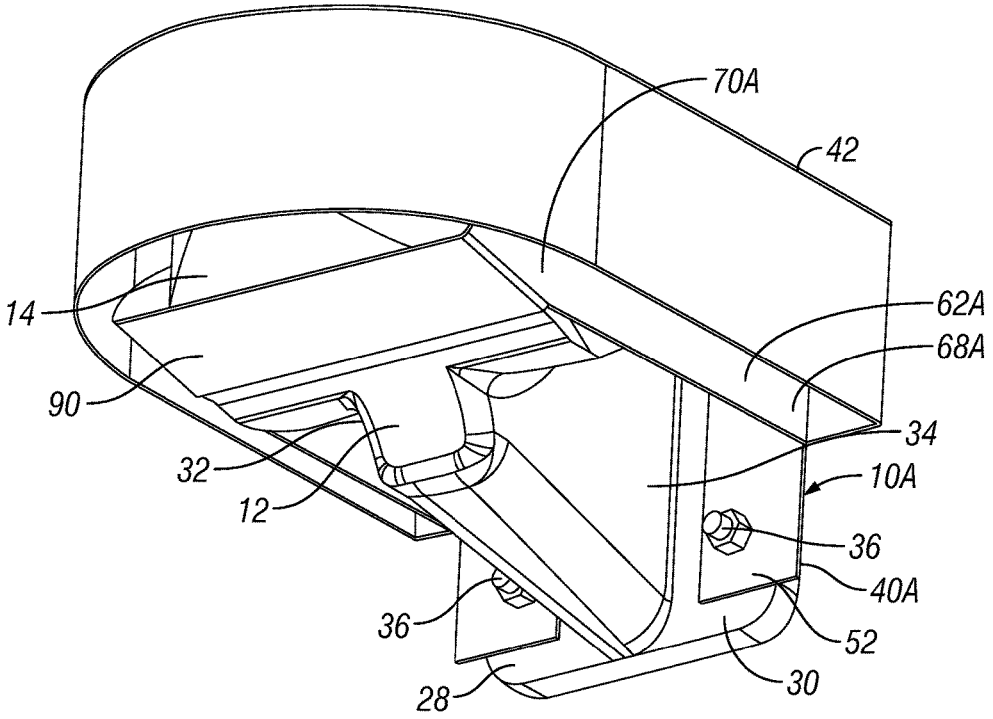
FIG. 6 is a bottom perspective view of a second embodiment of the support assembly in which the frame comprises a cross bar under the forward end of the toilet bowl.

Typically, the toilet 12 comprises a bowl 14 defining an access opening 16 surrounded by a rim 18 (FIG. 4). A pivotally-mounted seat 20 is usually attached by bolts (not shown) that are attached to the rear of the bowl 14 using the holes 22 (FIG. 4). In a common configuration, the back of the bowl 14 is provided with mounting flanges 28 and 30 (FIGS. 3 & 6) on each of its first and second sides 32 and 34, and the mounting flanges include bolt holes (not shown) by which the toilet 12 is mounted to the wall (not shown) by a plurality of bolts designated collectively at 36 (FIG. 6).

In the embodiments shown in FIGS. 1-6, the brace assembly 10 comprises a brace 40 and a shroud 42. Preferably, the shroud 42 is integrally formed, such as by molding, of plastic or some other suitable composition. The shroud 42 is shaped to enclose the top portion of the toilet bowl 14 and the brace 40 installed on it. Of course, the shroud 42 has an opening 44 at least coextensive with the access opening 16 of the bowl 14.

In the embodiment shown in FIG. 1, the shroud 42 has an upper surface 48, and the opening 44 is in this upper surface. The shroud 42 is dimensioned so that the portion of the upper surface 48 immediately surrounding the opening 44 underlies the toilet seat 20 when the brace 40 is installed on the toilet 12 as shown.

Figure 2:
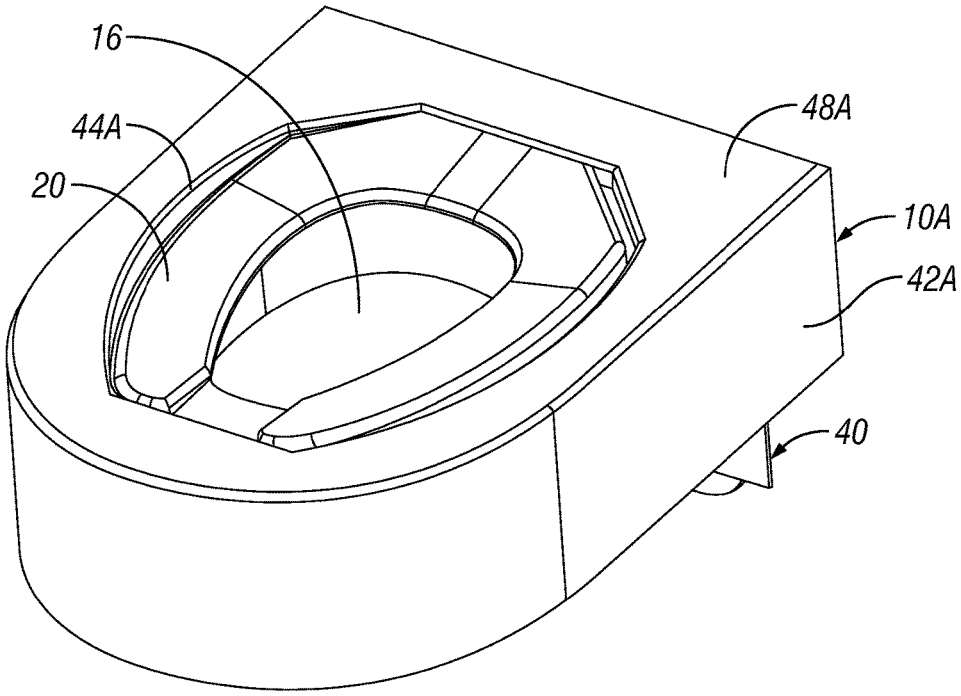
FIG. 2 is a perspective view of a toilet equipped with a cantilevered support in accordance with another embodiment of the present invention, in which the shroud is flush with the toilet seat.

FIG. 2 shows an alternative embodiment of the brace assembly designated at 10A. In this embodiment, the brace 40 is the same as in the first embodiment, but the shroud 42A is modified. Specifically, the shroud 42A is dimensioned so that the opening 44A in the upper surface 48A immediately surrounds the toilet seat 20 so that the upper surface is about flush with the toilet seat.

Now it will be appreciated that, in addition to the aesthetic purpose of hiding the brace, the shroud 42 and 42A also serves to widen the effective seating area of the toilet 12. This provides enhanced comfort to the larger or obese user.

Figure 5:
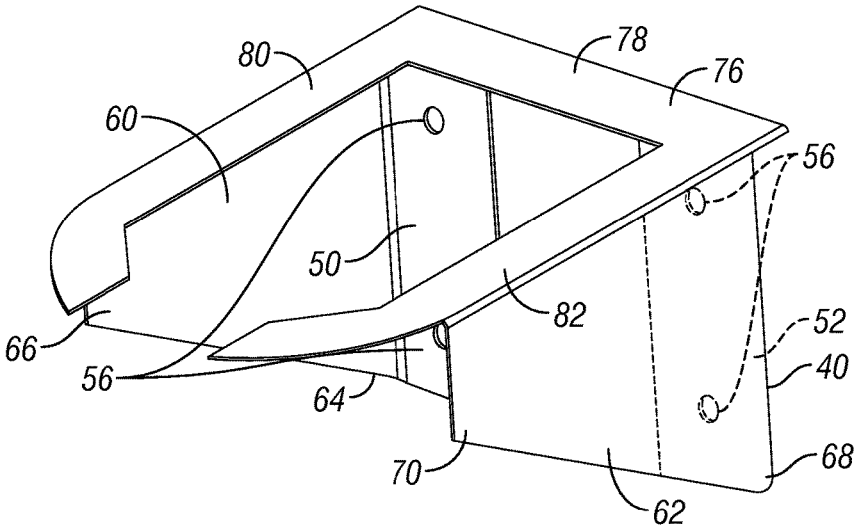
FIG. 5 is a top perspective view of the frame of the assembly of FIG. 4.

Referring now to FIGS. 3-5, the first preferred embodiment of the brace 40 will be described in more detail. The brace 40 comprises first and second wall-mounting plates 50 and 52. The first wall-mounting plate 50 is adapted to be mounted to the wall adjacent the first side 32 of the toilet bowl 14. Similarly, the second wall-mounting plate 52 is adapted to be mounted to the wall adjacent the second side 34 of the toilet bowl 14. Most preferably, the plates 50 and 52 are provided with bolt holes designated collectively at 56 (FIG. 5) positioned to be aligned with the bolt holes in the mounting flanges 28 and 30 of the toilet 12. In this way, the brace 40 can be attached to the wall by aligning the holes 56 in the plates 50 and 52 with the holes in the mounting flanges 28 and 30 of the toilet 12 and using the toilet bolts 36 to mount the aligned plates and flanges to the wall.

Referring still to FIGS. 3-5, the brace 40 further comprises first and second cantilevered struts 60 and 62. The strut 60 has first and second ends 64 and 66, and the strut 62 has first and second ends 68 and 70. The first ends 64 and 68 extend from the wall-mounting plates 50 and 52, respectively. In the embodiment, the struts 60 and 62 are irregularly-shaped, parallel, spaced-apart trapezoidal panels, but the configuration of these panels may vary.

The second ends 66 and 70 of the struts 60 and 62 are adapted to receive weight from a user seated on the toilet 12 and to transmit this weight through the struts into the wall. In the embodiment of FIGS. 3-5, the brace 40 comprises a seat structure 76 supported on the struts 60 and 62. The preferred shape of the seat structure 76 is generally U-shaped having a center portion 78 and a pair of opposing arms 80 and 82. See FIGS. 5 & 6. The seat structure 76 is dimensioned so that center portion 78 extends across the top rear of the toilet bowl 14 and so that the arms 80 and 82 extend forwardly from the center portion over and around the rim 18 of the bowl 14, as best seen in FIG. 4. As shown herein, the arms 80 and 82 have free ends that are spaced apart and positioned at the center front of the bowl 14. It will be understood that the arms could be shorter or longer and could join in the front to form a complete circle or oval.

When the brace 40 is installed on the toilet 12, the seat structure 76 is positioned slightly above the rim of the bowl 14 and the toilet seat 20 rests on top of the seat structure. Thus, the user's weight will be transferred from the seat 20 to the seat structure 76 of the brace 40, through the struts 60 and 62 and to the wall (not shown).

Figure 7:
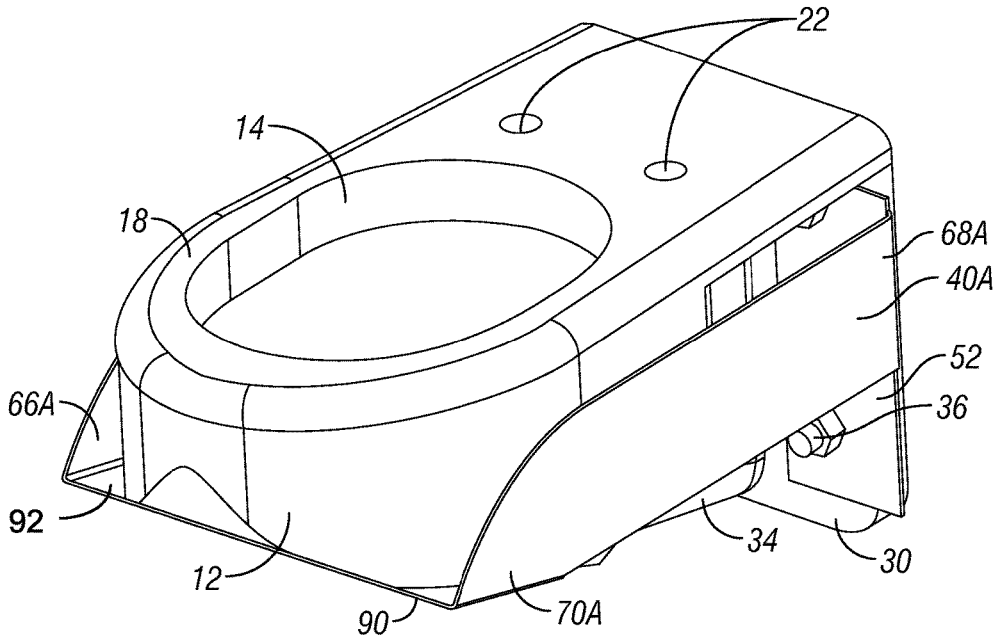
FIG. 7 is a top perspective view of the support assembly of FIG. 6 with the shroud removed.
Figure 8:
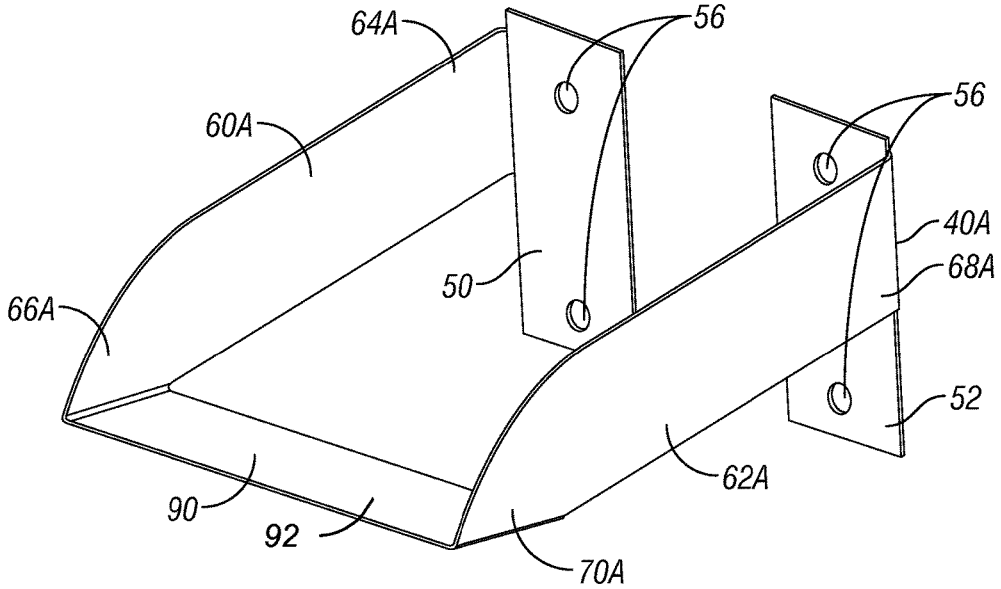
FIG. 8 is a top perspective view of the frame of the assembly of FIG. 6 apart from the toilet.
Figure 9:
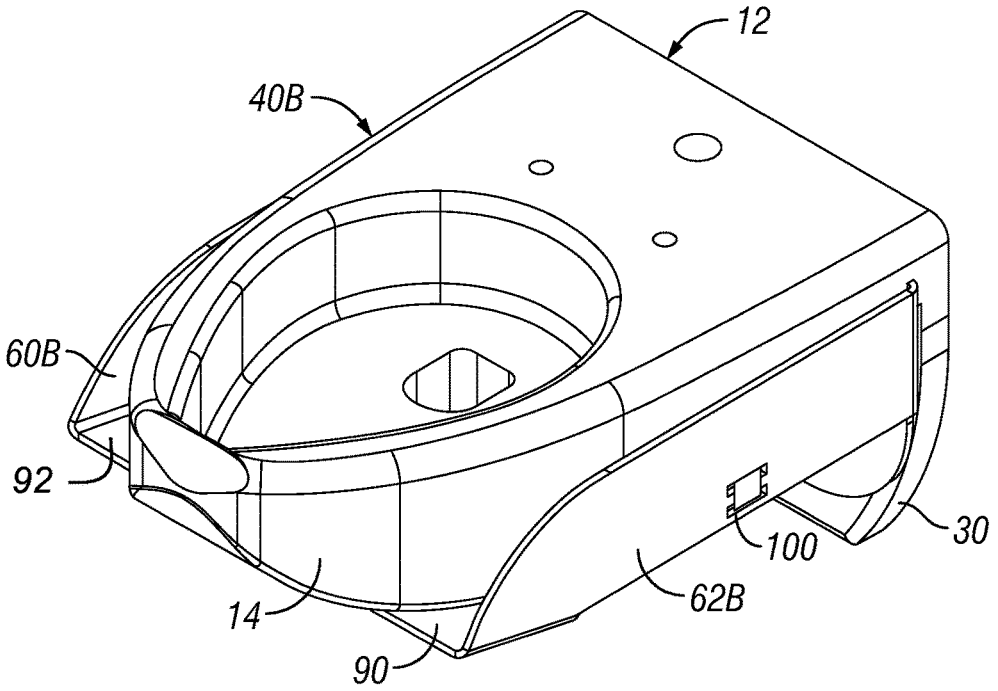
FIG. 9 is a top perspective view of a third embodiment of the support assembly comprising a frame that includes a flexible, adjustable cross strap underneath the toilet bowl in addition to the under-bowl cross bar.
Figure 10:
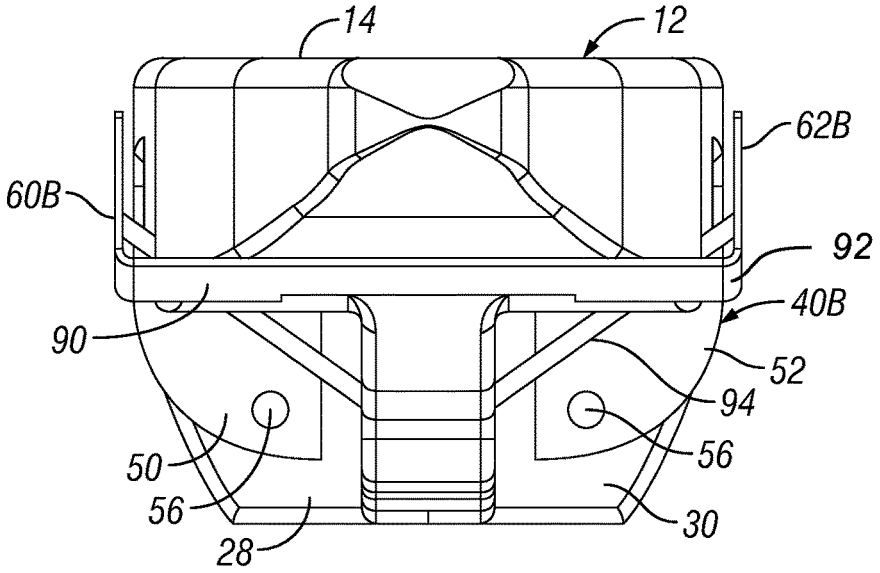
FIG. 10 is a front elevational view of the embodiment shown in FIG. 9.

Turning now to FIGS. 6-8, another embodiment of the brace will be described. The brace 40A comprises similar wall-mounting plates 50 and 52 with bolt holes 56, as described above relating to the embodiment of FIGS. 3-5.

The first and second cantilevered struts 60A and 62A are elongate bars. The strut 60A has first and second ends 64A and 66A, and the strut 62A has first and second ends 68A and 70A. The first ends 64A and 68A extend from the wall-mounting plates 50 and 52, respectively.

In place of the seat structure 76 in the preceding embodiment, the brace 40A includes an under-bowl support structure designated generally at 90. The under-bowl support structure 90 in this embodiment comprises a flat, rigid cross bar 92. The brace 40A is configured so that, when the brace is installed on the toilet 12, the cross bar 92 extends between the struts 60A and 62A underneath the toilet bowl 14 and most preferably the forward end of the toilet bowl. Thus, the user's weight will be transferred from the seat 20 to the bowl 14 of the toilet 12, and then to the bowl support structure 90 of the brace 40A, through the struts 60A and 62A and to the wall.

Either embodiment of the brace—the brace 40 with the seat structure 76 or the brace 40A with the under-bowl support structure 90—preferably is formed out of some sturdy and economical material, such as steel. Stainless steel may be used, but is not necessary. In most instances, the brace will be integrally formed of sheet steel, stainless steel, aluminum, reinforced plastic, fiberglass, and virtually any material providing the desired structural strength.

Although in one of the preferred embodiments, the brace is unitary, that is, formed of a single piece of metal or other material, other possible constructions will be immediately apparent. For example, the brace with a seat structure could comprise two separate side structures, each having a wall mounting plate, a strut and a partial seat structure. Still further, the seat structure and struts could be one unitary member that attach to two separate wall mounting plates. Similarly, the brace with the under-bowl support could be made as one unitary member comprising the two struts and the bowl support member attachable to separate wall mounting plates.

Yet another embodiment of the brace is shown in FIGS. 9-12, to which attention now is directed. In this embodiment, the brace 40B comprises similar wall-mounting plates 50 and 52 with bolt holes 56 (FIG. 10), as described above relating to the embodiment of FIGS. 6-8. The first and second cantilevered struts 60B and 62B are elongate bars.

Figure 11:
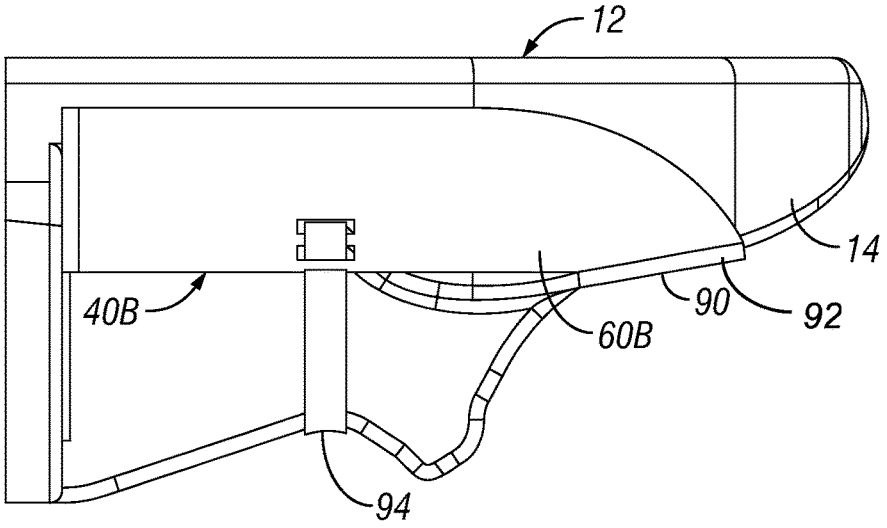
FIG. 11 is a side elevational view of the embodiment shown in FIG. 9.
Figure 12:
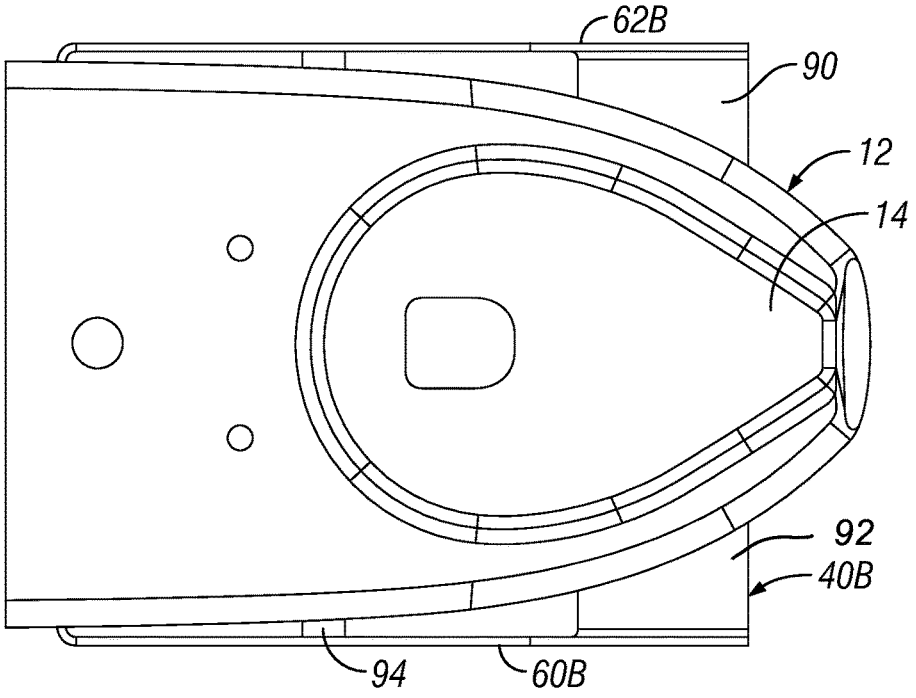
FIG. 12 is a plan view of the embodiment shown in FIG. 9.

In addition to the cross bar 92, the under-bowl support structure 90 further comprises a flexible, adjustable cross-strap 94 extending transversely between the struts 60B and 62B positioned rearward of the cross bar 92 and between the cross bar and mounting plates 50 and 52. For example, it may be positioned to support the toilet 12 near the rear of the bowl 14 or under the toilet between the wall and the rear of the bowl, as best seen in FIG. 11.

Preferably, the cross strap 94 is made of sturdy, woven, non-absorbent, synthetic material that is resistant to water and chemical damage and that is also flexible enough to conform to the bottom contour of the toilet bowl 14, which may vary depending on the brand, size and style of the toilet. This provides additional under-bowl support for the toilet and allows less movement between the toilet and the frame, especially under extreme weights.

In yet another embodiment of the brace shown in FIGS. 13A to 16B and designated as 40C, the under-bowl support structure 90 comprises a second cross strap 96 in place of the cross bar 92 and in addition to the first cross strap 94. Like the strap 94, the strap 96 is flexible and adjustable so that it can be tensioned to conform to the shape of the underside of the toilet bowl 14. A strut support bar 98 may be included near the forward (second) ends 66C and 70C of the struts 60C and 62C to maintain the proper position of the struts during weight bearing.

Figure 17:
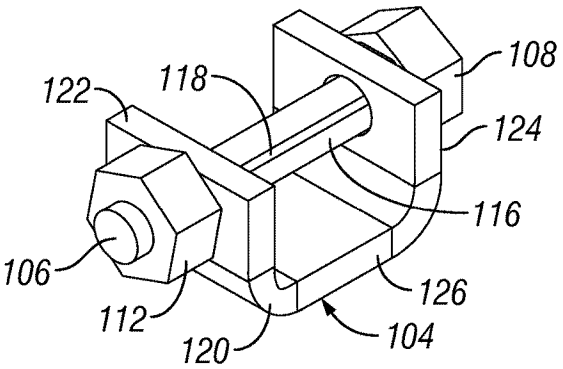
FIG. 17 shows a perspective view of a strap connector or "tie down" assembly.
Figure 18:
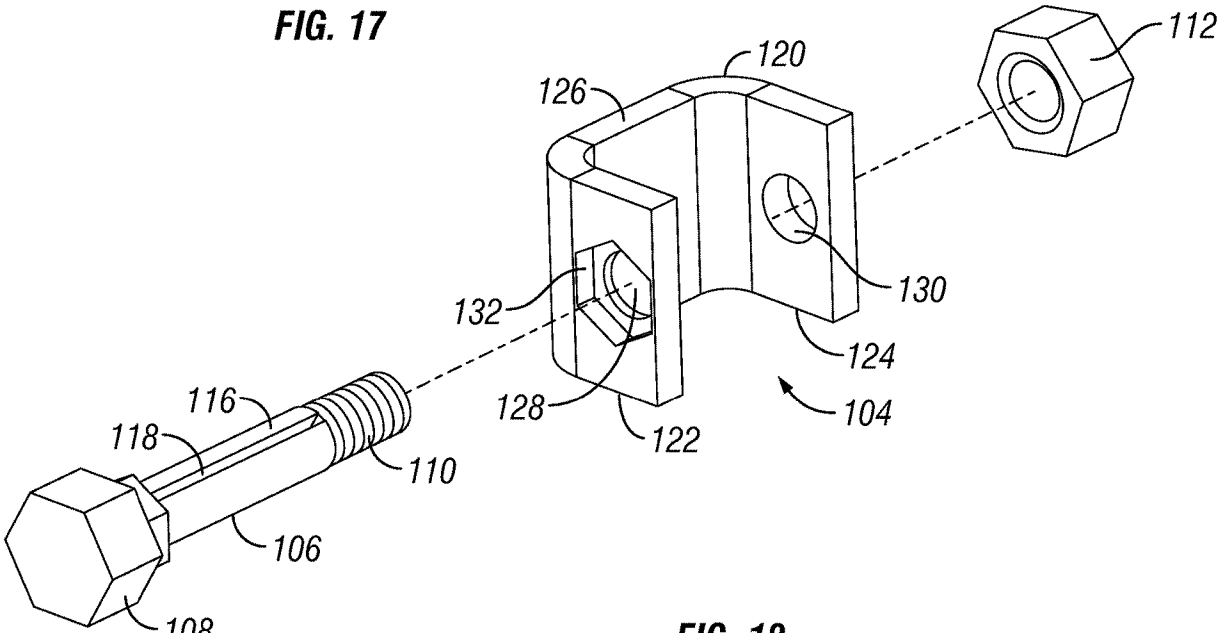
FIG. 18 shows an exploded perspective view of the strap connector assembly of FIG. 17.

Adjustability of the straps 94 and 96 may be provided in any suitable way, only one preferred way being illustrated and described herein. In the braces 40B and 40C, the straps 94 and 96 are slidably attached to the struts 60B, 60C and 62B, 62C, by running the straps through pairs of slots in the struts, the slot pairs being designated collectively as 100 in FIGS. 9-16B. Each of the straps 94 and 96 is formed into an endless ring—one end connected to the other—by means of a strap connector, such as the connector 104 shown in FIGS. 17 and 18.

Figure 13A:
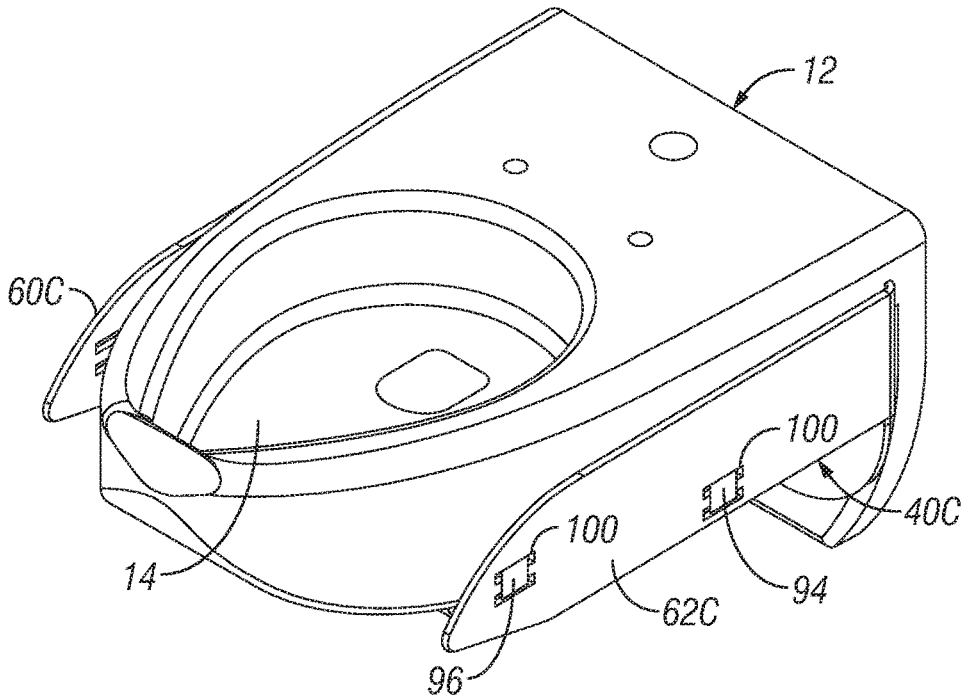
FIG. 13A shows a top perspective view of a fourth embodiment of the present invention wherein the frame includes a second flexible, adjustable cross strap at the front end of the toilet bowl instead of the rigid cross bar.
Figure 13B:
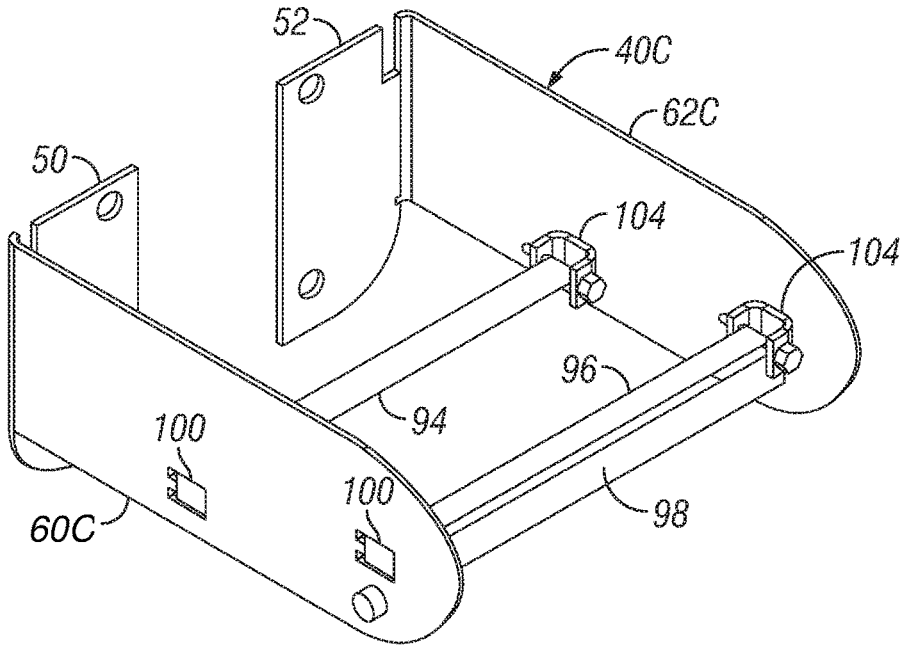
FIG. 13B shows a top perspective view of the frame of FIG. 13A apart from the toilet.
Figure 14A:
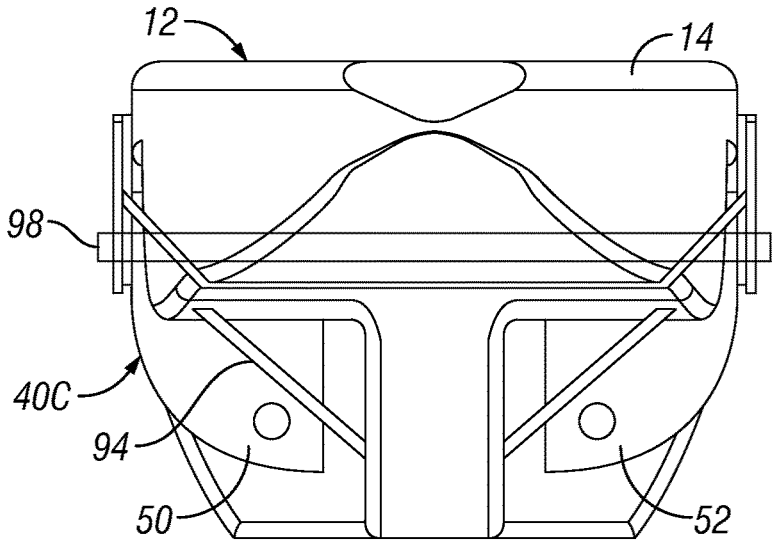
FIG. 14A shows a front elevational view of the toilet and frame of FIG. 13A.
Figure 14B:
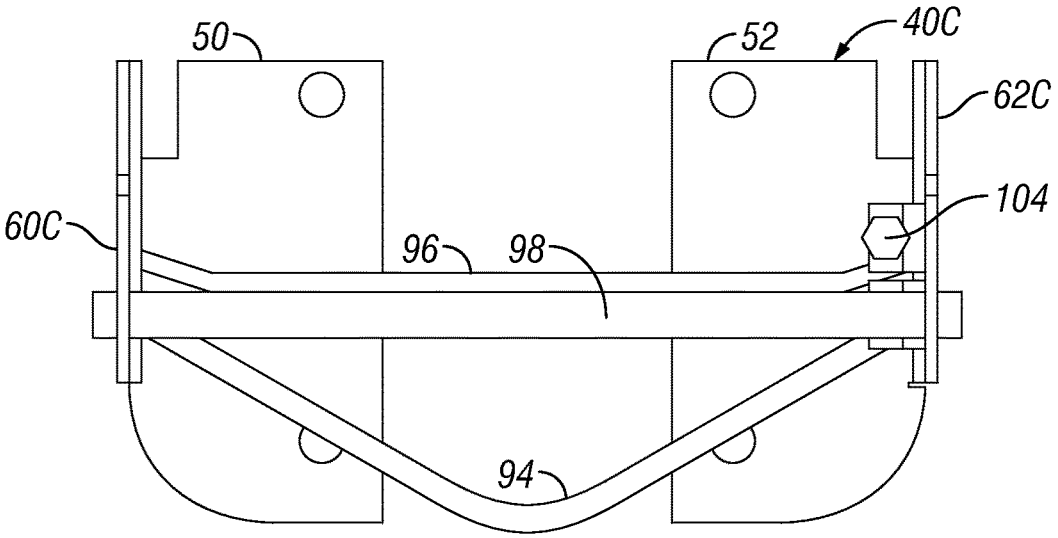
FIG. 14B shows a front elevational view of the frame of FIG. 13A apart from the toilet.
Figure 15A:
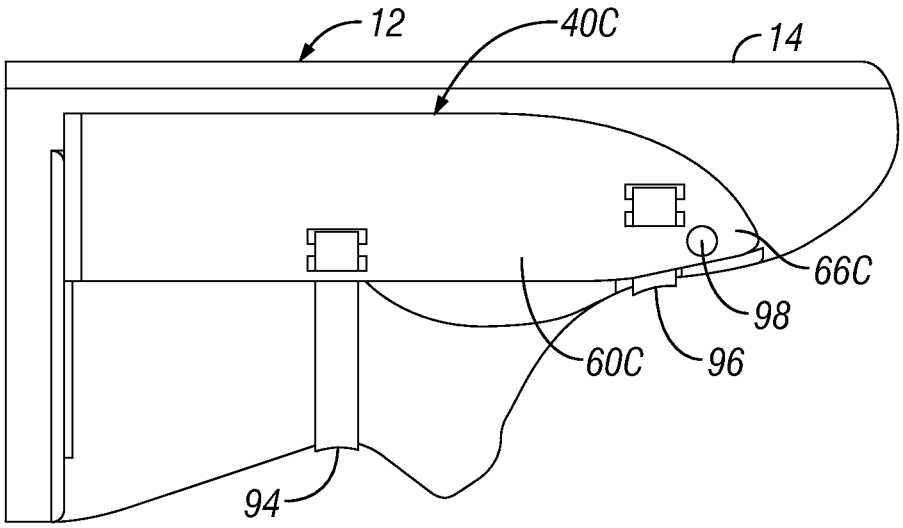
FIG. 15A shows a side elevational view of the toilet and frame of FIG. 13A.
Figure 15B:
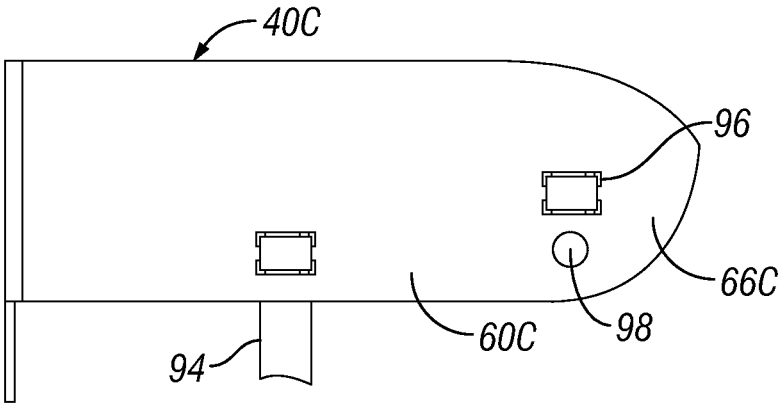
FIG. 15B shows a side elevational view of the frame of FIG. 13A apart from the toilet.
Figure 16A:
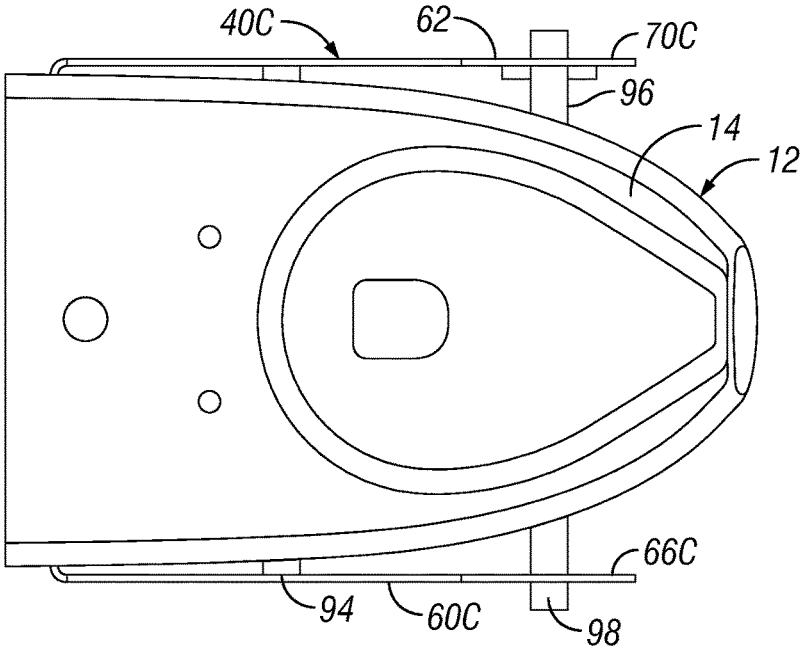
FIG. 16A shows a plan view of the toilet and frame of FIG. 13A.
Figure 16B:
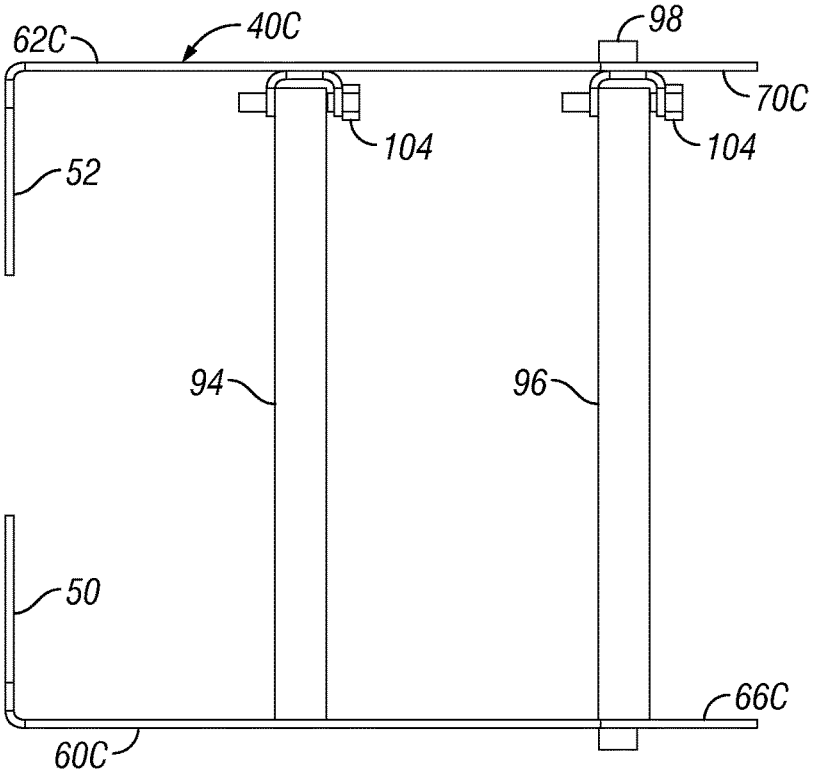
FIG. 16B shows a plan view of the frame of FIG. 13A apart from the toilet.

The connector 104 may be fixed by welding or the like to the inside of one of the struts 60C and 62C, as shown best in FIGS. 13B and 16B. The connector 104 may take many forms. In one suitable embodiment, the connector 104 comprises a bolt 106 with a head 108 and a threaded end 110. A nut 112 is receivable on the threaded end 110. The bolt 106 includes an elongate shaft 116 with a longitudinal slot 118 sized to receive the ends of the straps 96 and 98.

The connector 104 further comprises a bolt receiver 120 that may be U-shaped having ends 122 and 124 extending from a back 126. Bolt support holes 128 and 130 in the ends 122 and 124 of the receiver 120 rotatably support the bolt 106 so that the head 108 is on one side of the receiver 120 and the nut 112 is on the other.

With the ends (not shown) of the straps 94 and 96 in the slot 118, the slack in the strap is gradually taken up by slowly rotating the bolt head 108 until the strap has the desired tension. Once the desired tension is achieved in the straps 94 and 96, the bolt 106 is locked into position.

In the preferred structure, the lock is formed by making the head 108 polygonal, such as hexagonal, and providing a countersunk recess 132 around one of the bolt support holes 128 shaped to non-rotatingly receive the bolt head. Thus, once the desired tension is achieved by rotating the bolt 106, the bolt head 108 is pushed sideways into the recess 132, and the nut 112 is tightened to secure the position of the bolt 106 in the receiver 120.

Now it will be apparent that the present invention provides a simple and economical solution to the weight limitations of conventional wall-mounted porcelain toilets. The brace is simply constructed of steel or other suitable material and can be bolted to the wall using the same bolts as are used to mount standard toilets. The brace may include flexible, adjustable under-bowl straps that are conformable to any bowl contour, regardless of brand, size or style of the toilet, and will prevent undue movement between the frame and the toilet bowl. The shroud encloses the braced toilet bowl making the assembly more pleasing in appearance. Additionally, the upper surface of the shroud provides more comfortable seating.

The embodiments shown and described above are exemplary. Many details are often found in the art and, therefore, many such details are neither shown nor described herein. It is not claimed that all of the details, parts, elements, or steps described and shown were invented herein. Even though numerous characteristics and advantages of the present inventions have been described in the drawings and accompanying text, the description is illustrative only. Changes may be made in the details, especially in matters of shape, size, and arrangement of the parts within the principles of the inventions to the full extent indicated by the broad meaning of the terms of the attached claims. The description and drawings of the specific embodiments herein do not point out what an infringement of this patent would be, but rather provide an example of how to use and make the invention. The limits of the invention and the bounds of the patent protection are measured by and defined in the following claims.

What is claimed is:

1. A brace assembly for a wall-mounted toilet, wherein the toilet comprises a bowl mounted on a wall by a plurality of bolts, the bowl having a front and rear end, first and second sides, and an access opening defined by a rim, wherein the brace assembly comprises:

a brace comprising:

a first wall-mounting plate adapted to be mounted to the wall adjacent the first side of the toilet bowl;

a second wall-mounting plate adapted to be mounted to the wall adjacent the second side of the toilet bowl;

wherein the first and second wall-mounting plates include bolt holes positioned to permit the first and second wall-mounting plates to attach to the wall using the same bolts that attach the toilet bowl to the wall;

a first cantilevered strut having a first end and a second end, the first end extending from the first wall-mounting plate;

a second cantilevered strut having a first end and a second end, the first end extending from the second wall-mounting plate; and a weight receiving structure supported by the first and second struts and configured to receive weight from a user seated on the toilet and transmit the weight through the frame into the wall, wherein the weight receiving structure comprises a support extending between the first and second struts; and a non-weight bearing shroud shaped to enclose a top portion of the toilet bowl and a top portion of the brace when the brace is installed on it, the shroud having an opening at least coextensive with the access opening of the toilet bowl.

2. The brace assembly of claim 1 wherein the weight receiving structure comprises a seat structure supported by the first and second struts and configured to overlie and surround at least a portion of the rim of the toilet bowl so that at least a portion of the weight of a user seated on the toilet is transmitted directly to the frame and bypasses the toilet.

3. The brace assembly of claim 2 wherein the seat structure is configured to be positioned over the rim of the toilet bowl and under the toilet seat.

4. The brace assembly of claim 3 wherein the seat structure is generally U-shaped comprising a center portion and a pair of opposing arms, so that when the brace is installed on the toilet, the center portion extends across the top rear of the toilet bowl adjacent the wall and the opposing arms extend forwardly around the rim of the bowl.

5. The brace assembly of claim 1 wherein the weight receiving structure comprises an under-bowl support extending underneath the toilet bowl and between the first and second struts.

6. The brace assembly of claim 1 wherein the brace is made of steel.

7. The brace assembly of claim 6 wherein the brace is integrally formed.

8. The brace assembly of claim 1 wherein the toilet further includes a toilet seat, wherein the shroud includes an upper surface, and wherein the opening in the shroud is in the upper surface, and wherein the shroud is dimensioned so that the opening in the upper surface surrounds the toilet seat and so that the upper surface of the shroud is about flush with the toilet seat when the brace assembly is installed on the toilet.

9. The brace assembly of claim 1 wherein the toilet further includes a toilet seat, wherein the shroud includes an upper surface, and wherein the opening in the shroud is in the upper surface, and wherein the shroud is dimensioned so that the upper surface immediately surrounding the opening in the shroud underlies the toilet seat when the brace assembly is installed on the toilet.

10. A toilet assembly comprising a wall-mounted toilet and the brace assembly of claim 1.

11. The brace assembly of claim 5 wherein the under-bowl support comprises at least a first flexible, adjustable strap.

12. The brace assembly of claim 11 wherein the under-bowl support comprises at least a second flexible, adjustable strap.

13. The brace assembly of claim 12 wherein the first strap is positioned to support the rear end of the toilet bowl and wherein the second strap is positioned to support the forward end of the toilet bowl.

14. The brace assembly of claim 5 wherein the under-bowl support comprises a rigid cross bar.

15. The brace of claim 14 wherein the rigid cross bar is positioned under the forward end of the toilet bowl.

16. The brace assembly of claim 15 wherein the under-bowl support further comprises a flexible, adjustable strap positioned to support the rear end of the toilet bowl.

17. A toilet assembly comprising a wall-mounted toilet and the brace assembly of claim 5.

18. A toilet assembly comprising a wall-mounted toilet and the brace assembly of claim 13.

19. A toilet assembly comprising a wall-mounted toilet and the brace assembly of claim 16.

20. The brace assembly of claim 1 wherein the wall-mounted toilet comprises a toilet seat mounted on and supported by the toilet bowl.

21. The brace assembly of claim 2 wherein the wall-mounted toilet comprises a toilet seat mounted on and supported by the toilet bowl.

22. The brace assembly of claim 3 wherein the wall-mounted toilet comprises a toilet seat mounted on and supported by the toilet bowl.

23. The brace assembly of claim 8 wherein the wall-mounted toilet comprises a toilet seat mounted on and supported by the toilet bowl.

24. The brace assembly of claim 9 wherein the wall-mounted toilet comprises a toilet seat mounted on and supported by the toilet bowl.

25. A brace assembly for a wall-mounted toilet, wherein the toilet comprises a bowl mounted on a wall, the bowl having a front and rear end, first and second sides, and an access opening defined by a rim, wherein the toilet further includes a toilet seat, and wherein the brace assembly comprises:

a brace comprising:

a first wall-mounting plate adapted to be mounted to the wall adjacent the first side of the toilet bowl;

a second wall-mounting plate adapted to be mounted to the wall adjacent the second side of the toilet bowl;

a first cantilevered strut having a first end and a second end, the first end extending from the first wall-mounting plate; and a second cantilevered strut having a first end and a second end, the first end extending from the second wall-mounting plate; and a weight receiving structure supported by the first and second struts and configured to receive weight from a user seated on the toilet and transmit the weight through the frame into the wall; and a non-weight bearing shroud shaped to enclose a top portion of the toilet bowl and a top portion of the brace when the brace is installed on it, the shroud having an opening at least coextensive with the access opening of the toilet bowl, wherein the shroud includes an upper surface, and wherein the opening in the shroud is in the upper surface, and wherein the shroud is dimensioned so that the opening in the upper surface surrounds the toilet seat and so that the upper surface of the shroud is about flush with the toilet seat when the brace assembly is installed on the toilet.

26. A brace assembly for a wall-mounted toilet, wherein the toilet comprises a bowl mounted on a wall, the bowl having a front and rear end, first and second sides, and an access opening defined by a rim, wherein the toilet further includes a toilet seat, wherein the brace assembly comprises:

a brace comprising:

a first wall-mounting plate adapted to be mounted to the wall adjacent the first side of the toilet bowl;

a second wall-mounting plate adapted to be mounted to the wall adjacent the second side of the toilet bowl;

a first cantilevered strut having a first end and a second end, the first end extending from the first wall-mounting plate; and a second cantilevered strut having a first end and a second end, the first end extending from the second wall-mounting plate;

a weight receiving structure supported by the first and second struts and configured to receive weight from a user seated on the toilet and transmit the weight through the frame into the wall, wherein the weight receiving structure comprises a support extending between the first and second struts, and wherein the weight receiving structure comprises a seat structure supported by the first and second struts and configured to overlie and surround at least a portion of the rim of the toilet bowl so that at least a portion of the weight of a user seated on the toilet is transmitted directly to the frame and bypasses the toilet, and wherein the seat structure is configured to be positioned over the rim of the toilet bowl and under the toilet seat; and a non-weight bearing shroud shaped to enclose a top portion of the toilet bowl and a top portion of the brace when the brace is installed on it, the shroud having an opening at least coextensive with the access opening of the toilet bowl.

* * * * *